US009676518B2

(12) United States Patent
Shamp et al.

(10) Patent No.: US 9,676,518 B2
(45) Date of Patent: Jun. 13, 2017

(54) HANGING, STACKABLE AND NESTABLE INDUSTRIAL BIN

(71) Applicant: AKRO-MILS, a division of Myers Industries, Inc., Akron, OH (US)

(72) Inventors: Travis D. Shamp, Akron, OH (US); Christopher J. Clark, Akron, OH (US); Michael Weisburn, Massillon, OH (US)

(73) Assignee: Akro-Mils, a Division of Myers Industries, Inc., Akron, OH (US)

( * ) Notice: Subject to any disclaimer, the term of this patent is extended or adjusted under 35 U.S.C. 154(b) by 0 days.

(21) Appl. No.: 15/045,396

(22) Filed: Feb. 17, 2016

(65) Prior Publication Data

US 2017/0137173 A1 May 18, 2017

Related U.S. Application Data

(60) Provisional application No. 62/254,359, filed on Nov. 12, 2015.

(51) Int. Cl.
*A47F 5/08* (2006.01)
*A47F 3/14* (2006.01)
(Continued)

(52) U.S. Cl.
CPC ..... *B65D 21/0233* (2013.01); *A47B 87/0207* (2013.01); *A47F 5/08* (2013.01);
(Continued)

(58) Field of Classification Search
CPC .. B65D 21/0233; B65D 25/505; B65D 25/30; B65D 21/0234; B65D 21/00; B65D 21/02; B65D 21/0209; B65D 21/0212; B65D 21/0213; B65D 21/0215; B65D 21/0216; B65D 21/04; B65D 21/043; B65D 21/048; A47B 87/02; A47B 87/0207; A47B 87/0261; A47B 87/0276; A47B 96/027; A47F 5/08
(Continued)

(56) References Cited

U.S. PATENT DOCUMENTS

D191,144 S * 8/1961 Schanz ..... D3/307
3,113,680 A * 12/1963 Frater ..... B65D 21/048 206/507

(Continued)

*Primary Examiner* — Jennifer E Novosad
(74) *Attorney, Agent, or Firm* — Dureska & Moore, LLC; Brent I. Moore; David P. Dureska

(57) ABSTRACT

A hanging, stackable and nestable bin for storing parts and components used in assembly includes a pair of footers and a pair of footer depressions having a complimentary shape to one another. The hanging, stackable and nestable bin also includes a notch with a projection formed in the floor of the bin that extends transversely along the rear wall of the bin and a complimentary shaped upper rear wall rim. The footer, footer depressions, notch and upper rear wall rim provide three point stacking support when one bin is stacked onto another bin. In addition, the hanging, stackable and nestable bin includes sidewalls that are generally planar at the rear portion of the bin which aid in facilitating nesting of one bin into another bin. A cleat formed in the top rear wall of the bin provides rear hanging support for the bin.

18 Claims, 12 Drawing Sheets

(51) Int. Cl.

| | |
|---|---|
| ***A47B 43/00*** | (2006.01) |
| ***A47B 47/00*** | (2006.01) |
| ***A47B 57/00*** | (2006.01) |
| ***B65D 21/02*** | (2006.01) |
| ***B65D 25/20*** | (2006.01) |
| ***B65D 25/30*** | (2006.01) |
| ***A47B 87/02*** | (2006.01) |
| ***B65D 21/04*** | (2006.01) |

(52) U.S. Cl.
CPC ..... *B65D 21/048* (2013.01); *B65D 25/205* (2013.01); *B65D 25/30* (2013.01)

(58) Field of Classification Search
USPC ..... 211/90.01, 194, 126.7, 126.11, 126.12, 211/126.2, 87.01, 88.01, 193; 206/509–512, 503, 505, 515
See application file for complete search history.

(56) References Cited

U.S. PATENT DOCUMENTS 3,252,614 A * 5/1966 Evans ..... B65D 21/0212 108/152
3,342,346 A * 9/1967 Tucker ..... B65D 21/048 206/505
3,347,394 A * 10/1967 Gould ..... B65D 21/0212 206/509
3,478,892 A * 11/1969 Lockwood ..... A47B 87/00 108/91
3,534,866 A * 10/1970 Asenbauer ..... A47B 87/0269 206/507
3,791,528 A * 2/1974 Brendgord ..... A47B 87/0269 206/509
3,908,831 A * 9/1975 Brendgord ..... A47F 5/0025 211/126.2
4,015,713 A * 4/1977 Clipson ..... B65D 25/005 206/509
4,015,886 A * 4/1977 Wickenberg ..... A47B 87/00 206/509
4,131,203 A * 12/1978 Bridges ..... A47F 5/0025 108/32
4,160,570 A * 7/1979 Bridges ..... A47F 5/0853 108/32
4,372,444 A * 2/1983 Le Grand ..... B65D 25/06 206/505
4,473,155 A * 9/1984 Howitt ..... B65D 21/048 206/505
4,577,773 A * 3/1986 Bitel ..... A47B 88/20 206/561
5,071,008 A * 12/1991 Hradisky ..... B65D 21/048 206/507
5,190,156 A * 3/1993 Conaway ..... B62B 3/02 206/509
5,445,397 A * 8/1995 Evans ..... B62B 1/10 206/505
5,860,527 A * 1/1999 Frankenberg ..... B65D 1/22 206/509
6,386,365 B1 * 5/2002 Tan ..... B65D 21/062 206/505
6,527,122 B1 * 3/2003 Taylor ..... B65D 21/0212 206/509
D517,319 S * 3/2006 Wisnoski ..... D3/304
8,025,174 B2 * 9/2011 Martheenal ..... B65D 21/0216 206/510
8,152,005 B2 * 4/2012 Barkdoll ..... A47F 5/0838 211/88.01
D699,034 S * 2/2014 Engert ..... D3/304
8,960,469 B1 * 2/2015 Helal ..... B65D 21/0204 206/507
2009/0178989 A1 * 7/2009 Accuardi ..... A47B 87/0269 211/126.7
2014/0262910 A1 * 9/2014 Sommer ..... B65D 21/0216 206/509

* cited by examiner

HANGING, STACKABLE AND NESTABLE INDUSTRIAL BIN

CROSS-REFERENCE TO RELATED APPLICATIONS

This application claims the benefit of U.S. Provisional Patent Application Ser. No. 62/254,359, which was filed on Nov. 12, 2015.

BACKGROUND OF THE INVENTION

Technical Field

The present invention relates to the art of industrial storage and transport systems. More, particularly, the present invention relates to bin systems used for storing parts and components used in assembly. Even more particularly, the present invention is directed to a hanging, stackable and nestable storage bin which features, a cleat formed in the top rear of the bin that provides rear hanging support, a notch formed in the bottom rear of the bin that provides rear stacking support to the bin, and a pair of support structures positioned near the front of the bin that provide front stacking support to the bin. The combination of the rear and front supports prevents lateral movement of a second bin of the present invention stacked on a first bin of the present invention. The hanging, stackable and nestable bin of the present invention reduces the material required to form a bin capable of stably supporting stacking of a first bin on a second bin, thereby providing a more efficient bin stacking system with reduced manufacturing costs. Additionally, the bin of the present invention provides simplified nesting and removal of a first bin nested within a second bin.

Background Art

Bin systems are often used at industrial manufacturing and warehousing sites to aid in storing, sorting, and transfer of small parts. Prior art bins typically feature the ability to be stacked on, and/or nested within, one another. In prior art stackable and nestable bins, the bins typically feature at least two pairs of downwardly extending footers which extend outwardly from the fore and aft sidewalls of the bin. When a first bin is stacked on a second bin, the footers of the first bin are mated with footer depressions formed on the second bin, which provides stacking support. In contrast, non-stackable bins generally feature a cube design, lacking the outwardly formed side walls required to support stacking. As a result, prior art stackable and nestable bins are generally formed using more material compared to their non-stackable counterparts. Additionally, because of the complex design required for stacking in prior art stackable and nestable bins, nesting of a first bin within a second bin can be cumbersome.

A need exists in the art for a hanging, stackable and nestable bin design with hanging support, improved stacking support and simplified nesting, while providing a design which offers the material saving benefits of prior art non-stackable bins. The improved hanging, stackable and nestable bin of the present invention satisfies these needs, as will be described below.

BRIEF SUMMARY OF THE INVENTION

An objective of the present invention is to provide a bin which reduces the amount of material required to form a bin capable of stably supporting stacking of a first bin on a second bin and thus provide a more efficient bin stacking system with reduced manufacturing costs.

Another objective of the present invention is to provide a bin which simplifies nesting and removal of a first bin nested within a second bin.

Yet another objective of the present invention is to provide a bin which is capable of being hung from a louvered panel.

The objectives and others are obtained by the hanging, stackable and nestable industrial bin of the present invention which includes a floor, a rear wall integrally formed with the floor, a transversely extending notch formed between the floor and the rear wall, the rear wall including an upper rim having a longitudinal profile generally complementary to a longitudinal profile of the notch, a first sidewall integrally formed with the floor and the rear wall, a second sidewall integrally formed with the floor and the rear wall, the second sidewall transversely spaced from the first sidewall, a front wall integrally formed with the floor, the first sidewall, and the second sidewall, a pair of seating rims, wherein one of the pair of seating rims is formed on an interior surface of the first sidewall and the other of the pair of seating rims is formed on an interior surface of the second sidewall; and a pair of footers, wherein one of the pair of footers extends downwardly from the first side wall and the other of the pair of footers extends downwardly from said second side wall.

BRIEF DESCRIPTION OF THE SEVERAL VIEWS OF THE DRAWINGS

The preferred embodiment nestable and stackable bin of the present invention, illustrative of the best mode in which Applicant has contemplated applying the principles of the present invention, is set forth in the following description and is shown in the drawings.

Similar numerals refer to similar parts through the drawings.

DETAILED DESCRIPTION OF THE INVENTION

Figure 1:
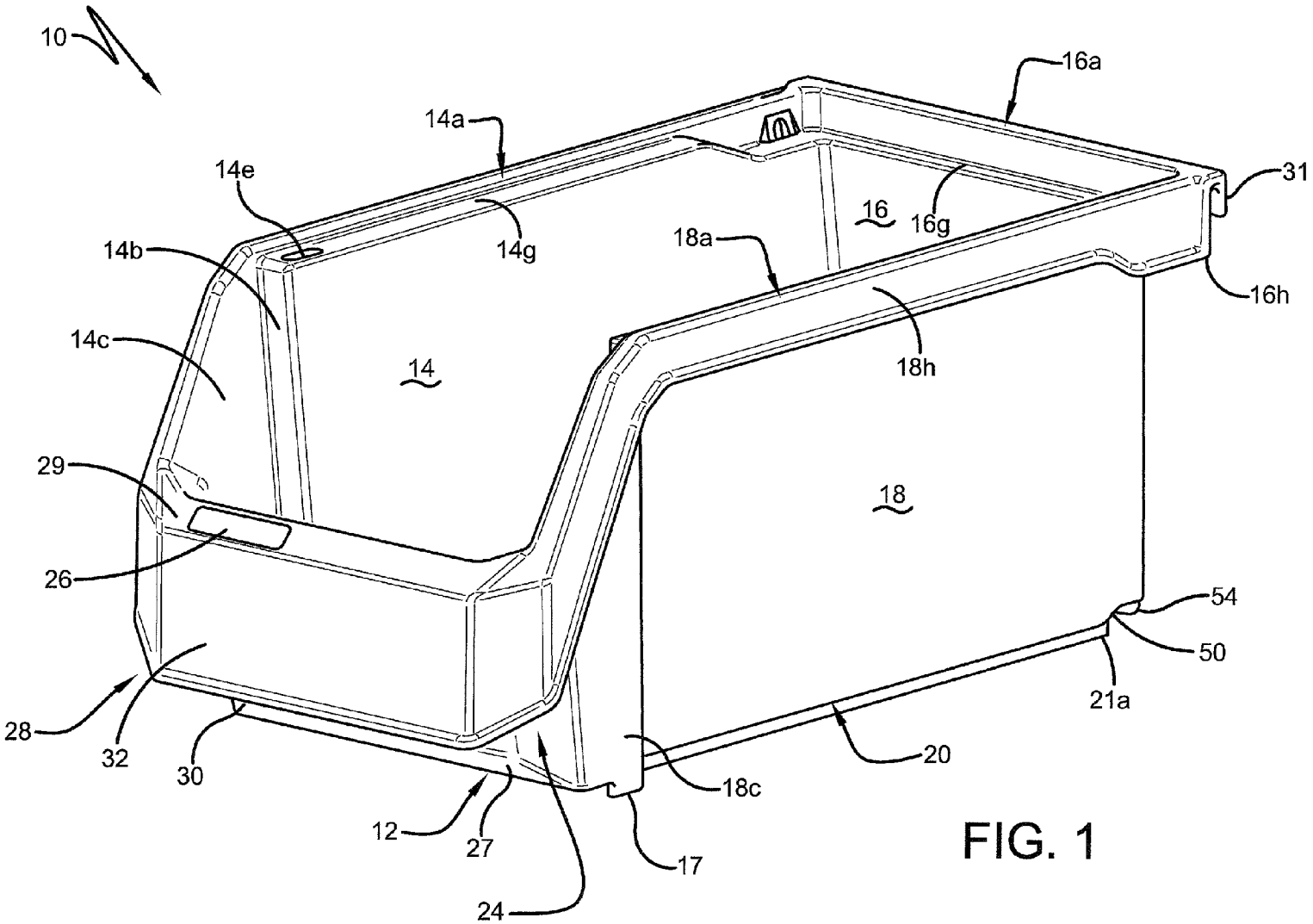
FIG. 1 is a top-front perspective view of a preferred embodiment hanging, stackable and nestable bin of the present invention.

A preferred embodiment hanging, stackable and nestable bin of the present invention is shown in FIGS. 1-4B, and is indicated generally at reference numeral 10. With particular reference to FIG. 1, preferred embodiment hanging, stackable and nestable bin 10 of the present invention generally includes a bin floor 20, a rear wall 16, a front wall 12, a first sidewall 14 and a transversely-spaced opposing second sidewall 18.

Figure 1A:
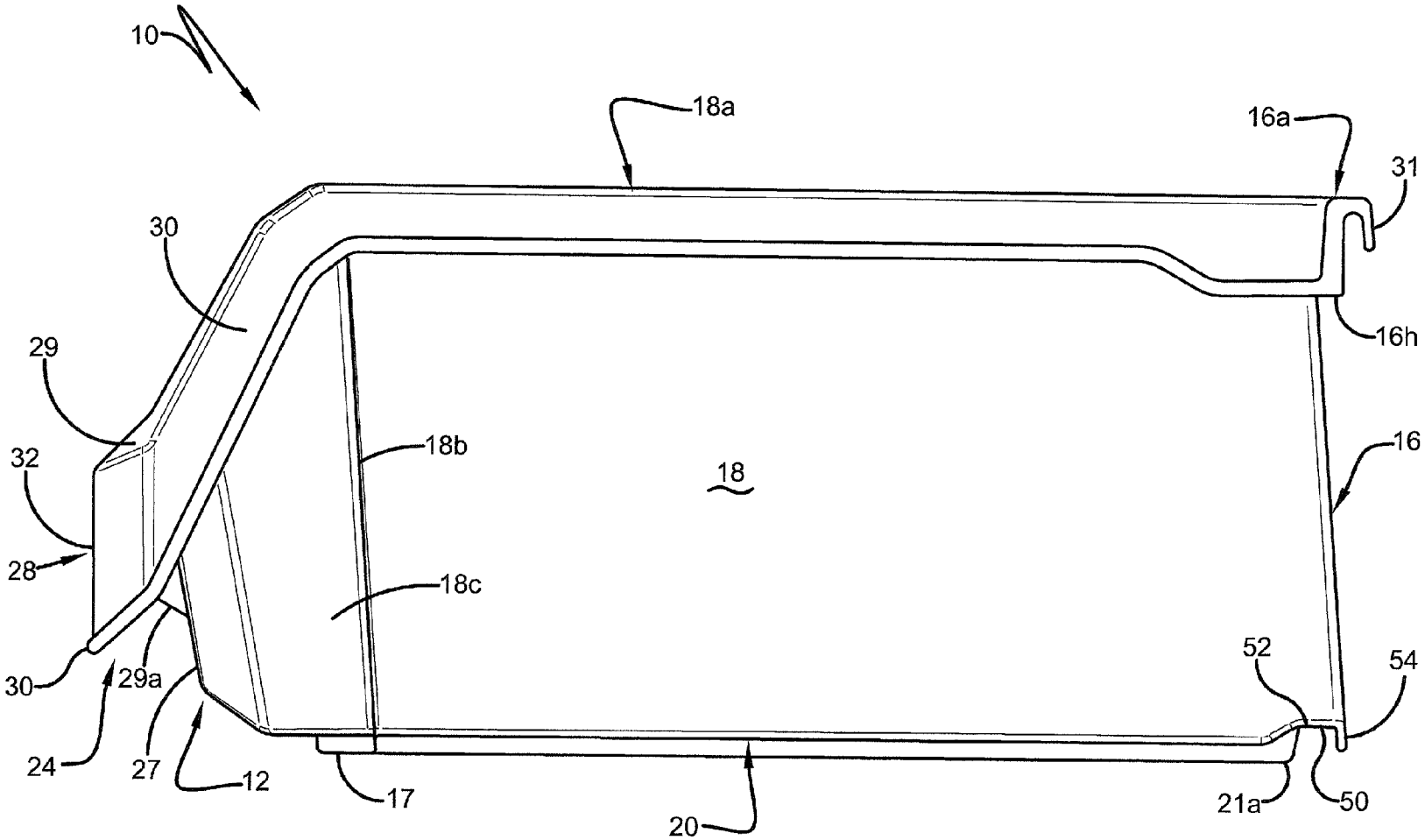
FIG. 1A is a side elevational view of the preferred embodiment hanging, stackable and nestable bin shown in FIG. 1.
Figure 1B:
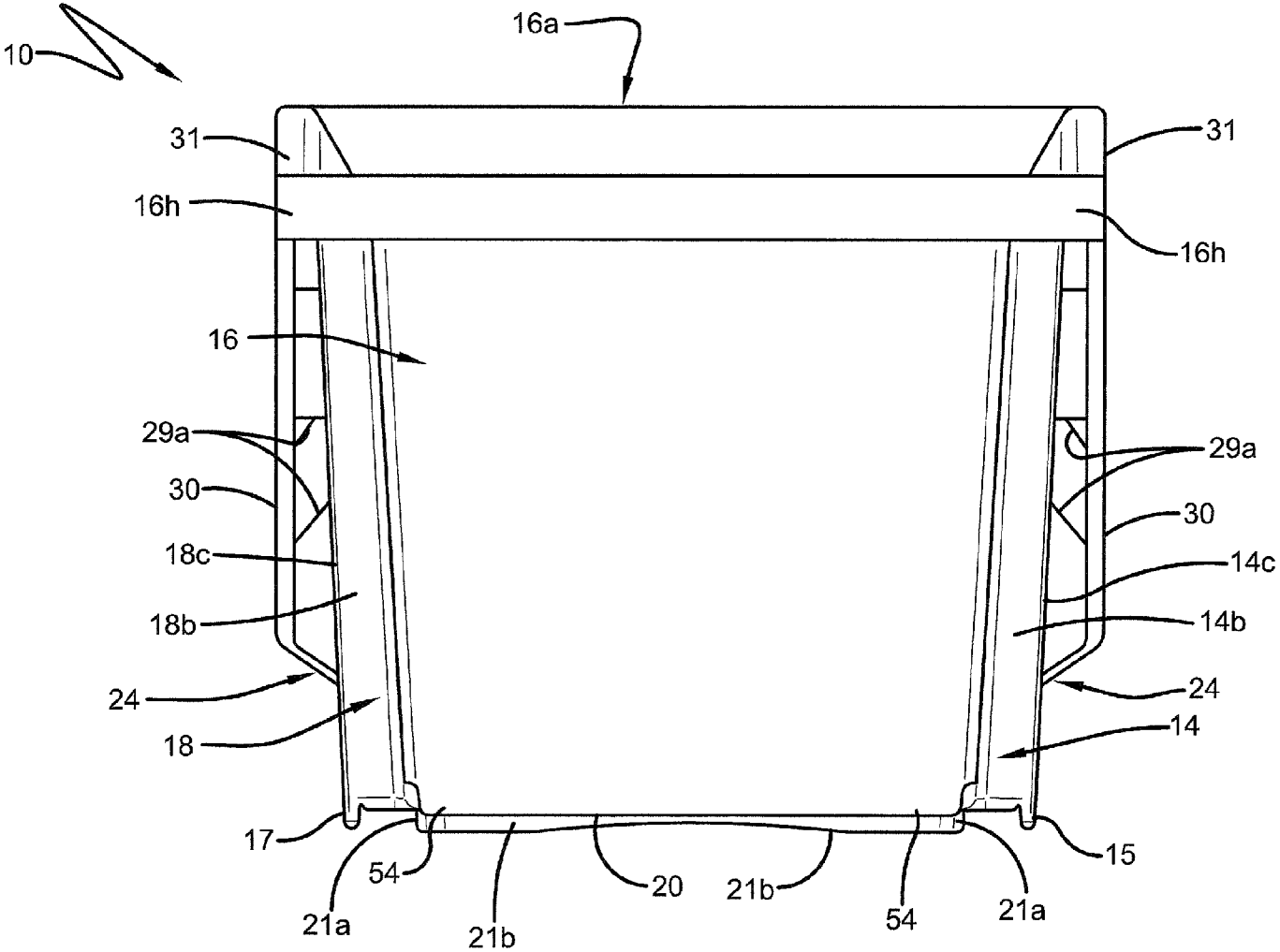
FIG. 1B is a rear elevational view of the preferred embodiment hanging, stackable and nestable bin shown in FIG. 1.
Figure 1C:
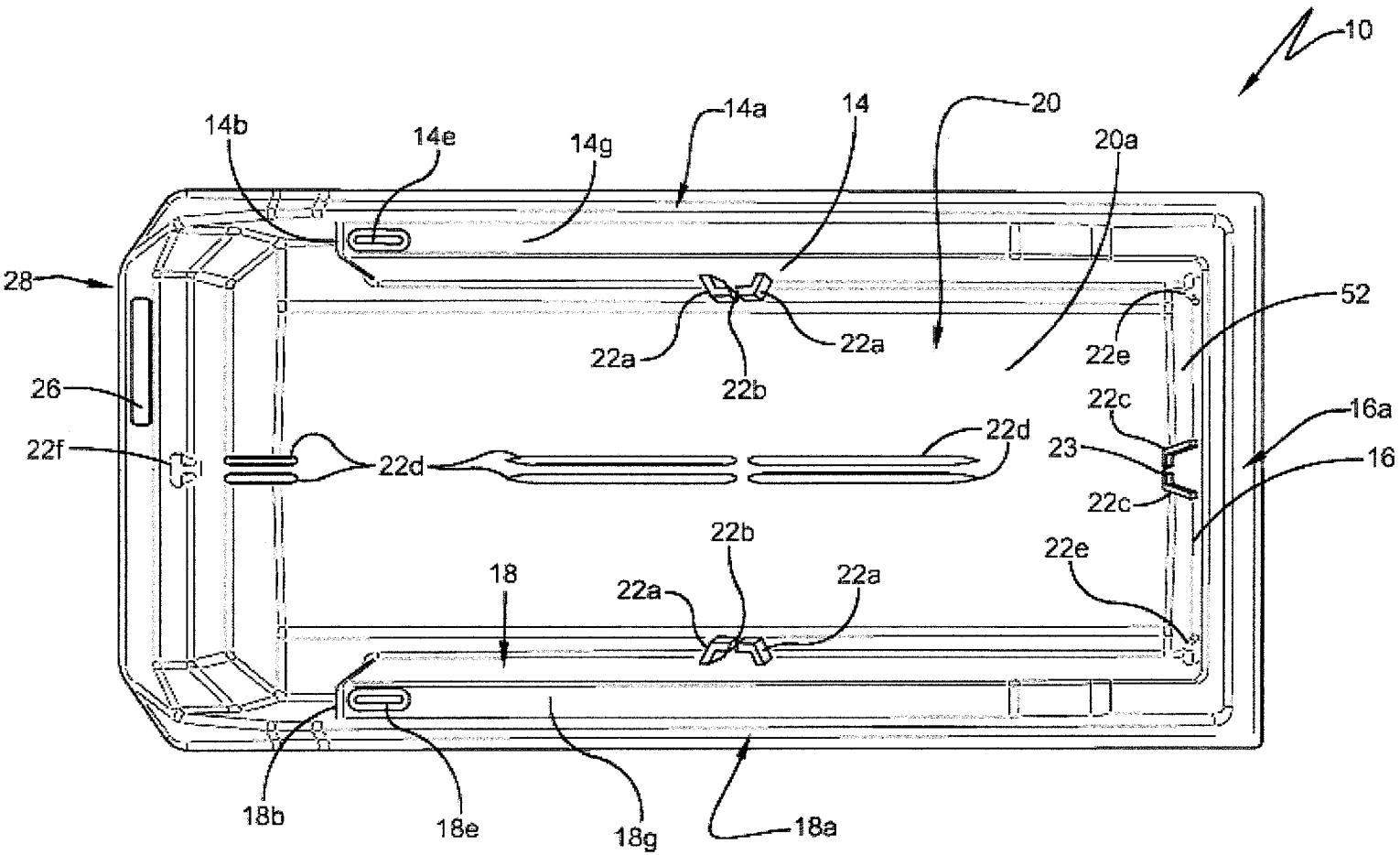
FIG. 1C is a top plan view of the preferred embodiment hanging, stackable and nestable bin shown in FIG. 1.
Figure 1D:
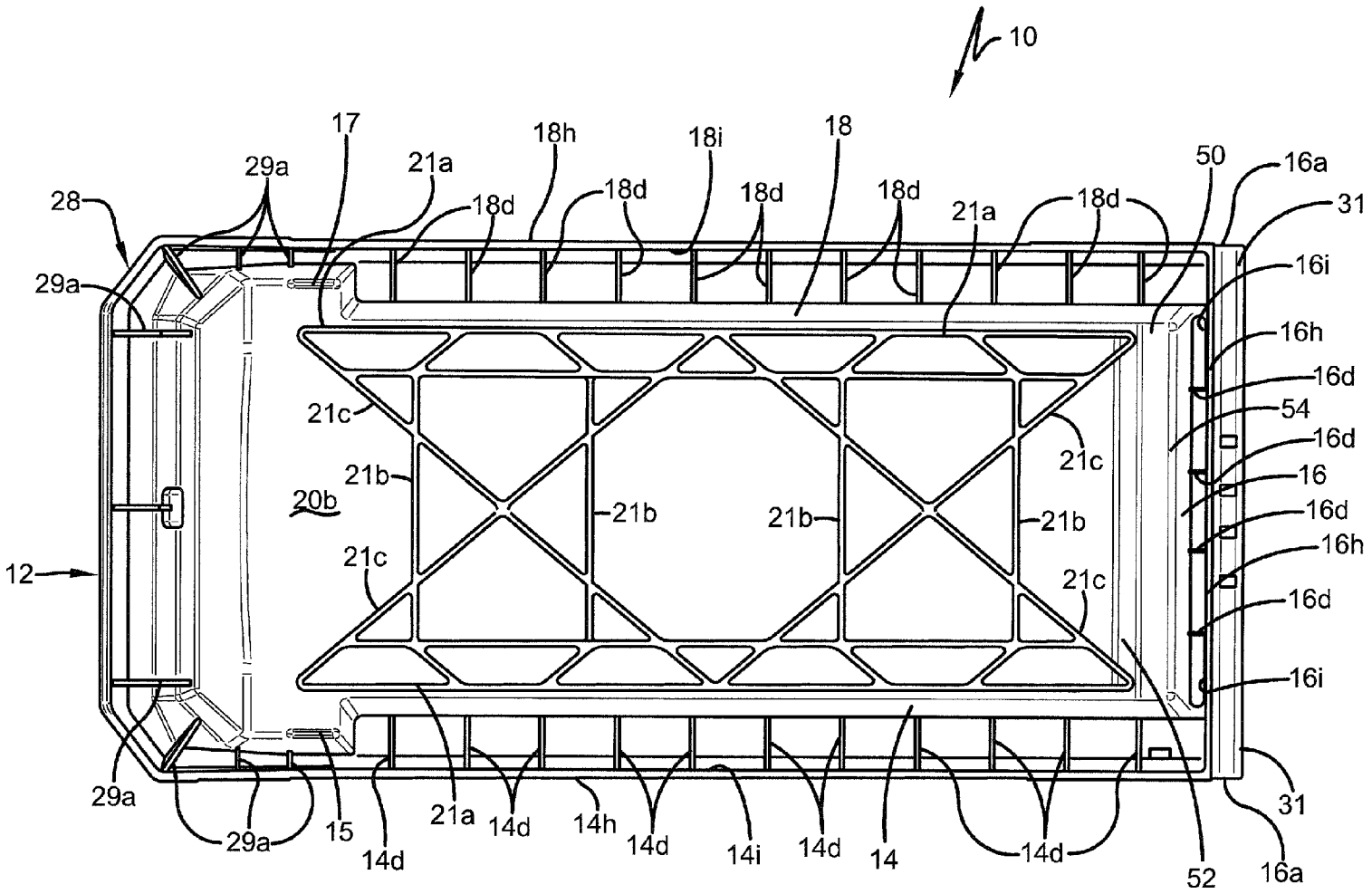
FIG. 1D is a bottom plan view of the preferred embodiment hanging, stackable and nestable bin shown in FIG. 1.

With continued reference to FIG. 1, front wall 12 includes a multi-faceted retaining wall 27 and a forward extending faceted hand hold 28. Hand hold 28 is angled generally away from retaining wall 27. Handhold 28 includes an upper rim 29 and a downwardly extending overhang 30. Overhang 30 includes a labeling area 32 for attachment of a label to identify the contents of bin 10 during use. A logo forming area 26 is formed in upper rim 29 and provides a location for molding a company logo (not shown) into the bin upper rim. Overhang 30 is integrally formed with, and extends downwardly from upper rim 29. A plurality of rib structures 29*a* extend between overhang 30 and upper rim 29 to provide support to the overhang (FIGS. 1A and 1D). Because handhold 28 is angled away from retaining wall 27, a hollow 24, representing the space between overhang 30 and retaining 27, allows users of bin 10 to insert their fingers into to the hollow to pull the bin towards them during use.

With particular reference to FIGS. 1-1D, first sidewall 14 generally includes an upper rim 14*a*, a kick out wall 14*b*, and a fore wall 14*c*. Fore wall 14*c* is integrally formed with retaining wall 27 of front wall 12. A footer 15 extends downwardly from, and is continuously formed with fore wall 14*c*. First sidewall 14 is formed slightly inwardly from upper rim 14*a* and fore wall 14*c*. First sidewall 14 includes an inner flat seating rim 14*g*. A footer depression 14*e* is formed near the front of inner flat seating rim 14*g* and provides stacking support for a second bin 10, as will be described in greater detail below. Upper rim 14*a* includes an overhang 14*h*. Overhang 14*h* is integrally formed with, and extends outwardly and downwardly from upper rim 14*a*, forming a space 14*i* (FIG. 1D) between the overhang and the rim. As is best shown in FIG. 1D, a plurality of rib structures 14*d* extend between overhang 14*h* and upper rim 14*a* to provide support to the overhang. Upper rim 14*a* is integrally formed with handhold 28 of front wall 12. Like hollow 24 that is located between overhang 30 and retaining wall 27 of front wall 12, space 14*i* of first sidewall 14 allows users of bin 10 to insert their fingers into the space in order to aid in lifting or moving the bin.

Figure 5:
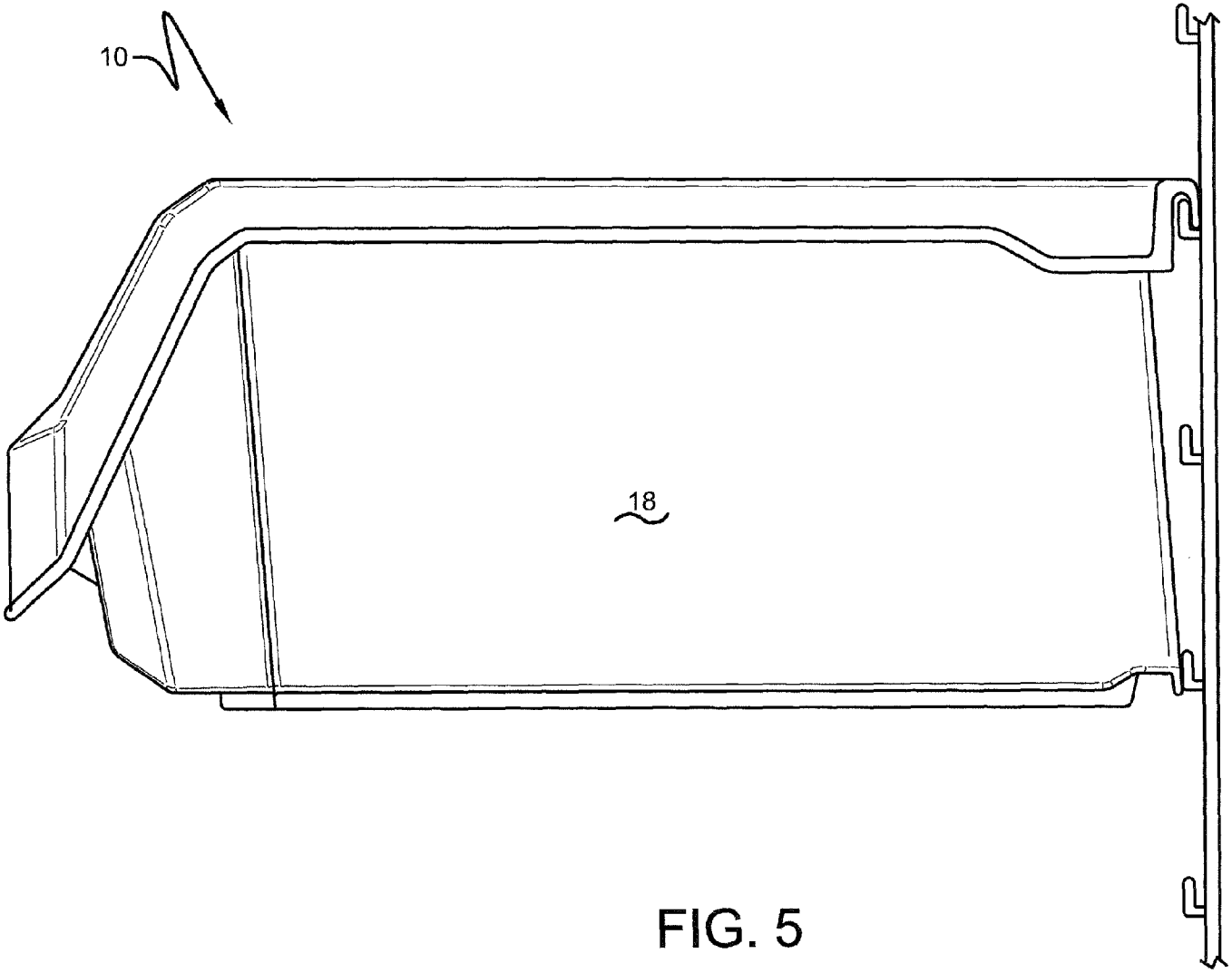
FIG. 5 is a side elevational view of the preferred embodiment hanging, stackable and nestable bin shown in FIG. 1, showing the bin hanging from a louvered panel.

With continued reference to FIGS. 1-1D, second sidewall 18 generally includes an upper rim 18*a*, a kick out wall 18*b*, and a fore wall 18*c*. Fore wall 18*c* is integrally formed with retaining wall 27 of front wall 12. A footer 17 extends downwardly from, and is continuously formed with fore wall 18*c*. Sidewall 18 is formed slightly inwardly from upper rim 18*a* and fore wall 18*c*. Second sidewall 18 includes an inner flat seating rim 18*g* (FIG. 1C). A footer depression 18*e* is formed near the front of inner flat seating rim 18*g* and provides stacking support for a second bin 10, as will be described in greater detail below. Upper rim 18*a* includes an overhang 18*h*. Overhang 18*h* is integrally formed with, and extends outwardly and downwardly from upper rim 18*a*, forming a space 18*i* (FIG. 1D) between the overhang and the rim. As is best shown in FIG. 1D, a plurality of rib structures 18*d* extend between overhang 18*h* and upper rim 18*a* to provide support to the overhang. Upper rim 18*a* is integrally formed with handhold 28 of front wall 12. Like hollow 24 that is located between overhang 30 and retaining wall 27 of front wall 12, space 18*i* of second sidewall 18 allows users of bin 10 to insert their fingers into the space in order to aid in lifting or moving the bin. With particular reference to FIGS. 1, 1B, and 1C, rear wall 16 includes an upper rim 16*a*. Rear wall 16 is formed slightly inwardly from upper rim 16*a*. Rear wall 16 includes an inner flat seating rim 16*g*. Inner flat seating rim 16*g* is perpendicular to and integrally formed with each seating rim 14*g*,18*g* of first and second sidewalls 14,18, respectively, forming a continuous seating surface along the inside of the first and second sidewalls and rear wall 16. Upper rim 16*a* includes a downward extending overhang 16*h*. Overhang 16*h* is integrally formed with, and extends downwardly from upper rim 16*a*, forming a space 16*i* (FIG. 1D) between the overhang and rear wall 16. As is best shown in FIG. 1D, a plurality of rib structures 16*d* extend between overhang 16*h* and rear wall 16 to provide support. Upper rim 16*a* is perpendicular to and integrally formed with each upper rim 14*a*, 18*a* of first and second sidewalls 14,18, respectively, forming a continuous rim around preferred embodiment bin 10. Upper rim 16*a* includes a cleat 31 that extends downwardly from the upper rim and provides a means to hang bin 10 from a louver panel, or other similar fixture, as shown in FIG. 5, allowing preferred embodiment bin 10 to be elevated during use.

With particular reference to FIGS. 1C and 1D, bin floor 20 includes an interior surface 20*a* and an exterior surface 20*b*. Exterior surface 20*b* is formed with a plurality of longitudinal reinforcements 21*a*, a plurality of transverse reinforcements 21*b*, and a plurality of diagonal reinforcements 21*c*, the combination of which serves to reinforce the bin floor during high load situations. Additionally, longitudinal reinforcements 21*b* aid in stacking stability, as will be discussed in greater detail below. With continued reference to FIG. 1C, interior surface 20*a* of bin floor 20 is integrally formed with the bottom of retaining wall 27 of front wall 12, the bottom of each fore wall 14*c*,18*c* of first and second sidewalls 14,18, the bottom of each first and second sidewall 14,18, and the bottom of rear wall 16. A pair of transverse divider support structures 22*a* are integrally formed between interior surface 20*a* of bin floor 20 and the inward facing surface of first sidewall 14, creating a space 22*b* for insertion of a transverse divider (not shown) within bin 10. A pair of transverse divider support structures 22*a* are also integrally formed between interior surface 20*a* of bin floor 20 and the inward facing surface of second sidewall 18, creating a space 22*b* for insertion of a transverse divider (not shown) within bin 10. A pair of longitudinal divider supports 22*c* are formed between interior surface 20*a* of bin floor 20 and the inward facing surface of rear wall 16, creating a space 23 for insertion of a longitudinal divider (not shown). A generally T-shaped slot 22*f* is formed in the interior surface of front wall 12 for insertion of the front end of the longitudinal divider (not shown) A plurality of divider alignment fins 22*d* are formed on interior surface 20*a* and provide additional support for the installation of a transverse divider (not shown) and a longitudinal divider (not shown). A pair of upwardly extending support structures 22*e* are formed at the rear of interior surface 20*a*, and provide support for the nesting of a second bin, as will be described in greater detail below.

In accordance with an important feature of the preferred embodiment hanging, stackable and nestable bin 10 of the present invention, and with particular reference to FIG. 1A, a notch 50 is formed generally in the bottom surface of bin floor 20 extending transversely along rear wall 16. More specifically, the integral connection between bin floor 20 and rear wall 16 form an upward ridge 52 (FIG. 1D). A projection 54 extends downwardly from rear wall 16 beyond the integral connection between bin floor 20 and rear wall 16. As is best shown in FIG. 1B, projection 54 extends downwardly the longitudinal length of rear wall 16. With particular reference to FIG. 1A, notch 50 features a generally upside down U-shaped profile formed by the spatial relationship of projection 54, longitudinal reinforcements 21*a*, and ridge 52. The longitudinal profile of notch 50 is complementary to the longitudinal profile of upper rim 16*a* of rear wall 16. Because the longitudinal profile of notch 50 is complementary to the profile of upper rim 16*a*, when a preferred embodiment first bin 10 is stacked on top of a preferred embodiment second bin 10, notch 50 of the first bin rests on or mates with the upper rim of the second bin. With specific reference to FIGS. 4-4B, because projection 54 extends downwardly from the integral connection between bin floor 20 and rear wall 16, when the first bin notch 50 is resting on or mated with upper rim 16*a* on second bin, the downward projection provides stacking stability, preventing the first bin from sliding forwardly within the stacking arrangement.

In accordance with another important feature of the present invention, and with particular reference to FIGS. 1 and 1D, footer depression 14*e* of seating rim 14*g* of first sidewall 14 features an inward geometry complementary to the outward geometry of footer 15. The complementary geometry of footer depression 14*e* and footer 15 enables mating of the footer of a first bin within the footer depression of a second bin during stacking, as shown in FIGS. 4 and 4A.

Likewise, each footer depression 18*e* (FIG. 1C) of seating rim 18*g* of second sidewall 18 features an inward geometry complementary to the outward geometry of each footer 17. The complementary geometry of footer depression 18*e* and footer 17 enables mating of the footer of a first bin within the footer depression of a second bin during stacking, as shown in FIGS. 4 and 4A. Footers 15 and 17 are transversely spaced at a distance equal to the transverse spacing between each footer depression 14*e*,18*e* of bin 10.

Figure 4:
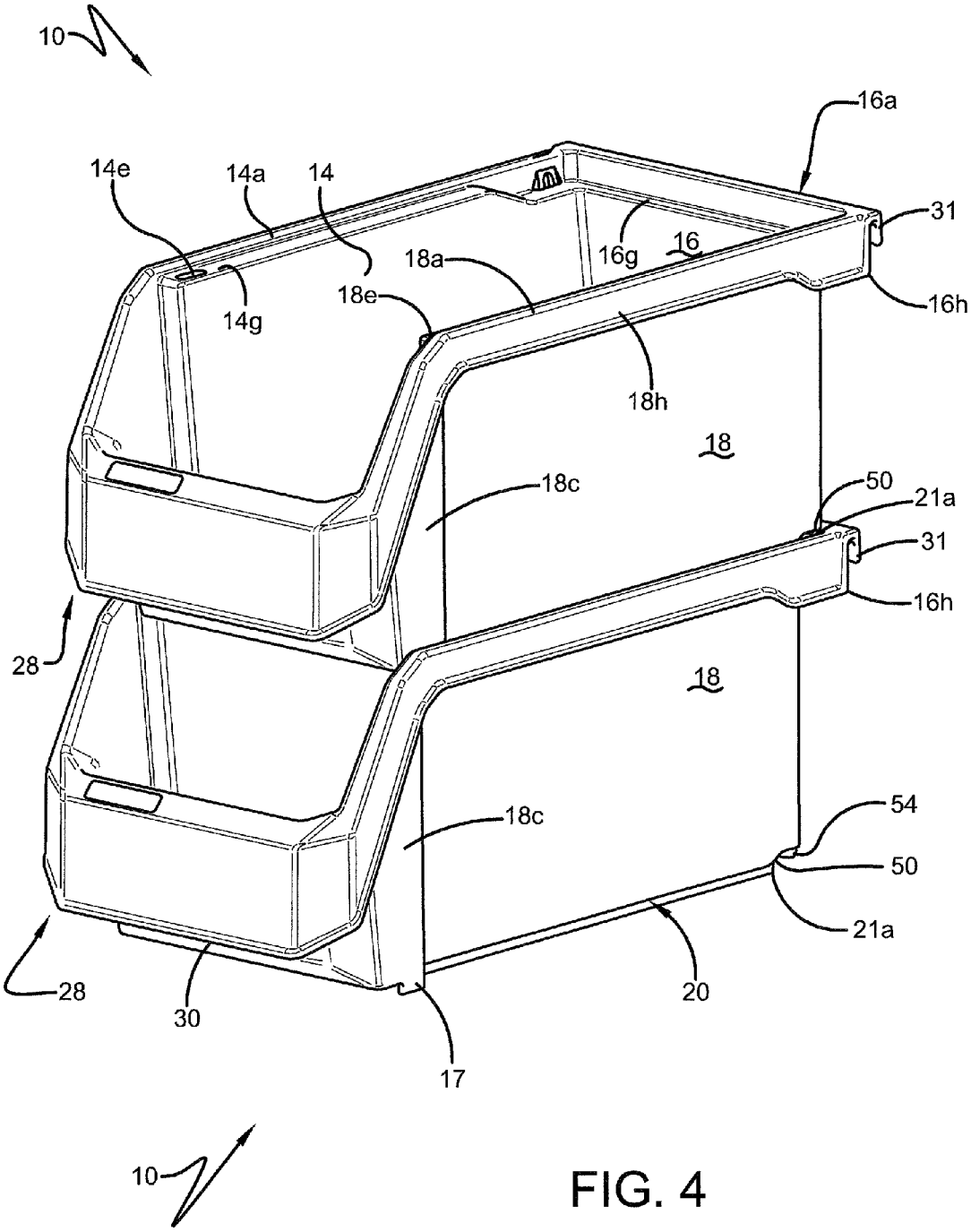
FIG. 4 is a top front perspective view of a pair of preferred embodiment hanging, stackable and nestable bins of the present invention, showing a first bin stacked on a second bin.
Figure 4A:
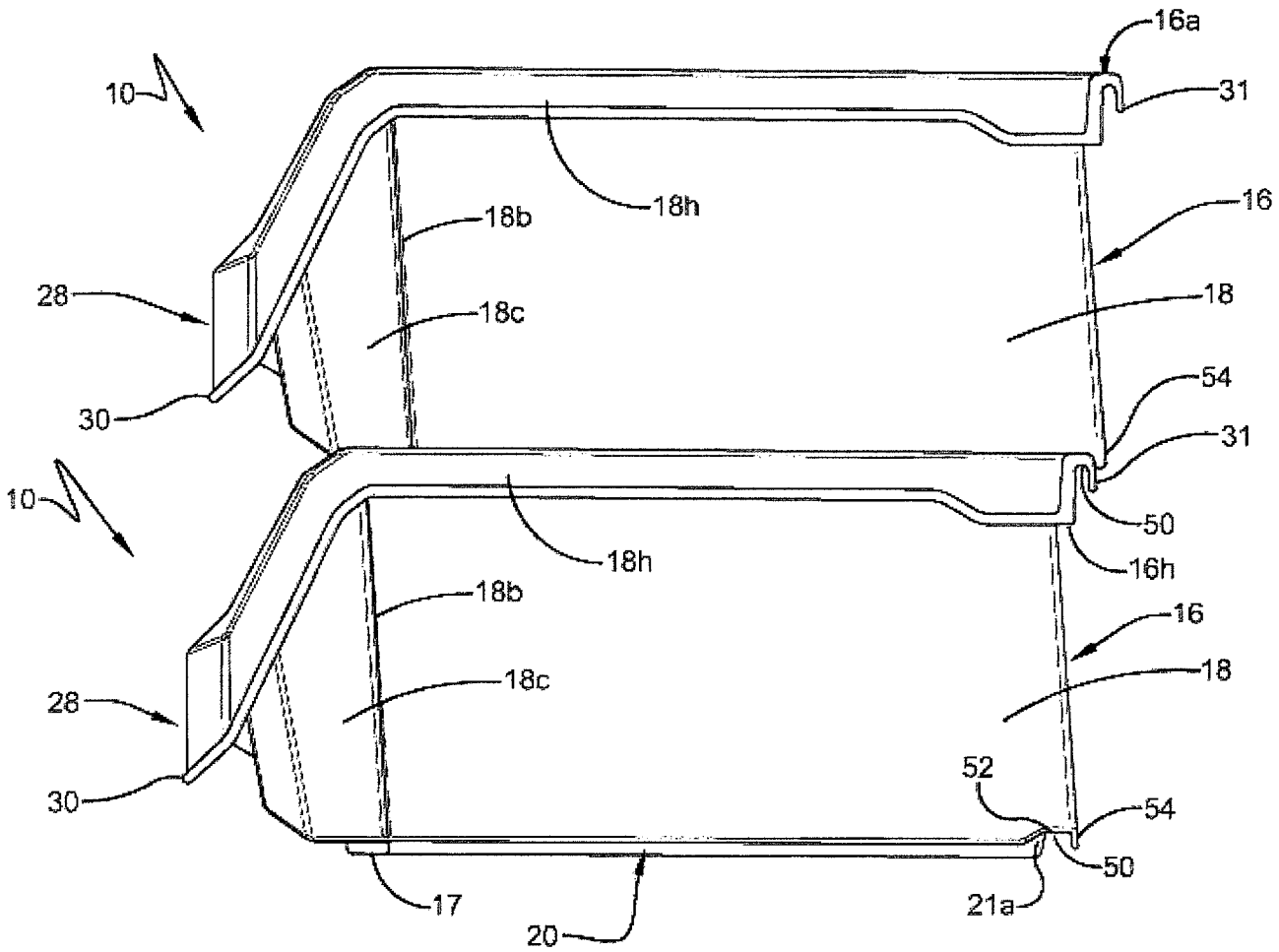
FIG. 4A is a side elevational view of the preferred embodiment hanging, stackable and nestable bins shown in FIG. 4.
Figure 4B:
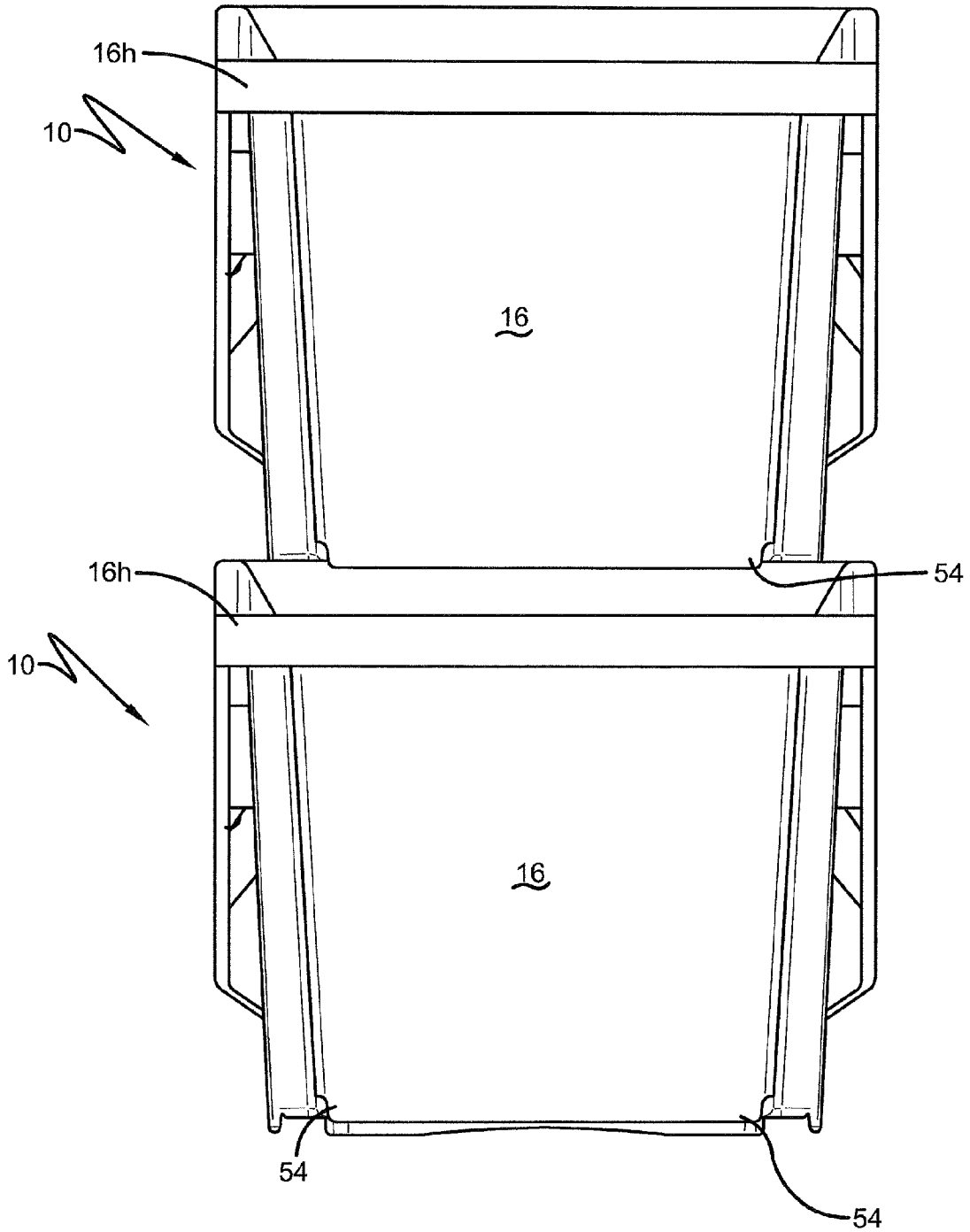
FIG. 4B is a rear elevational view of the preferred embodiment hanging, stackable and nestable bins shown in FIG. 4.

With particular reference to FIGS. 4 and 4A, during stacking of a preferred embodiment first bin 10 on a preferred embodiment second bin 10, when notch 50 of the first bin is resting on or mated with upper rim 16*a* of the second bin, first sidewall footer 15 (FIG. 1D) of the first bin vertically aligns with first sidewall footer depression 14*e* of the second bin.

Likewise, during stacking of a preferred embodiment first bin 10 on a preferred embodiment second bin 10, when notch 50 of the first bin is resting on or mated with upper rim 16*a* of the second bin, second sidewall footer 17 of the first bin vertically aligns with second sidewall footer depression 18*e* of the second bin.

The combination of notch 50 of the preferred embodiment first bin mating with upper rim 16*a* of the preferred embodiment second bin, and footers 15,17 of the first bin mating with footer depressions 14*e*,18*e*, respectively, of the second bin, provides stacking support which prevents horizontal movement of the first bin stacked onto the second bin.

Figure 2:
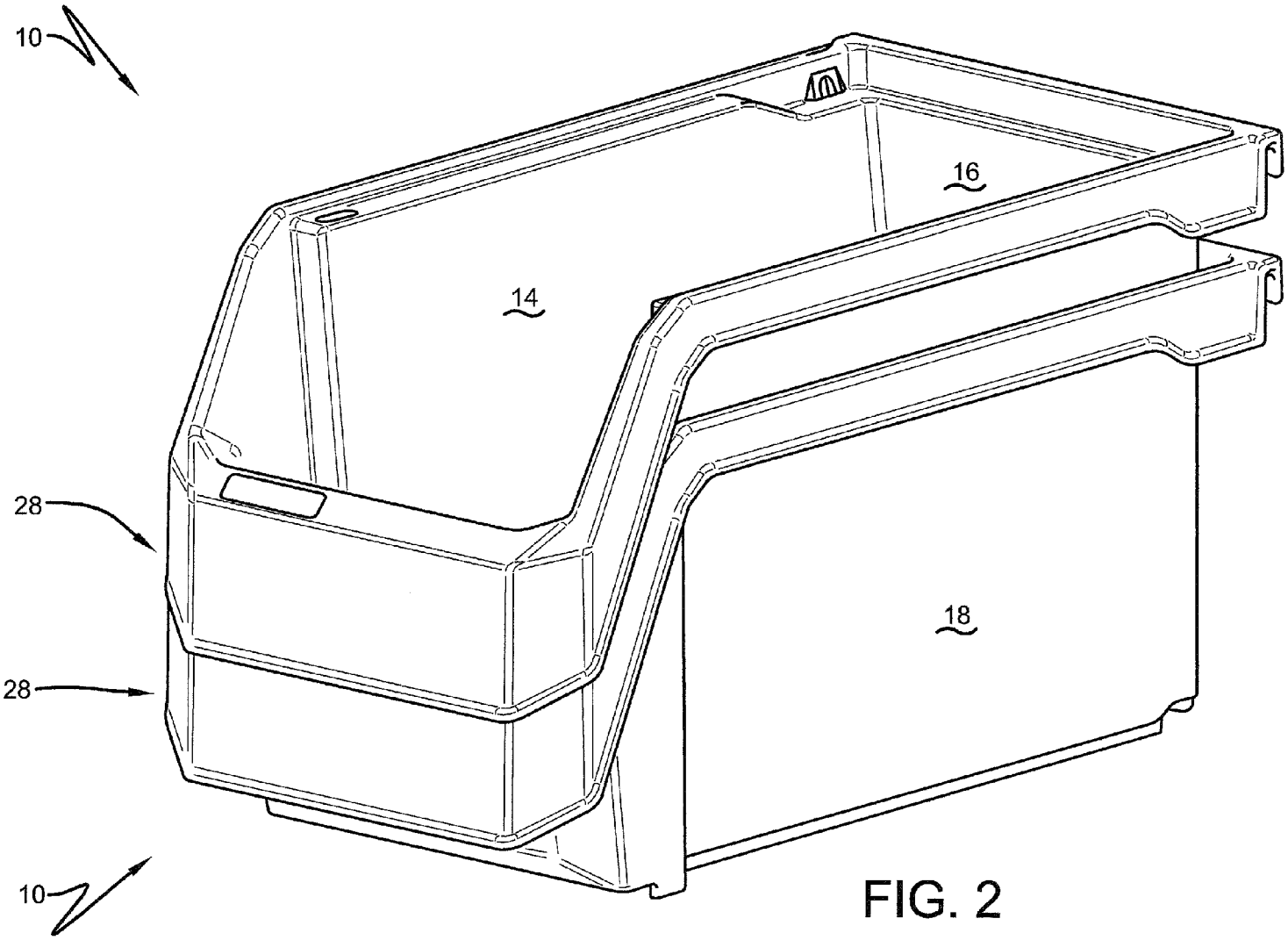
FIG. 2 is a top-front perspective view of a pair of preferred embodiment hanging, stackable and nestable bins of the present invention, showing the bins in a nested arrangement.
Figure 3:
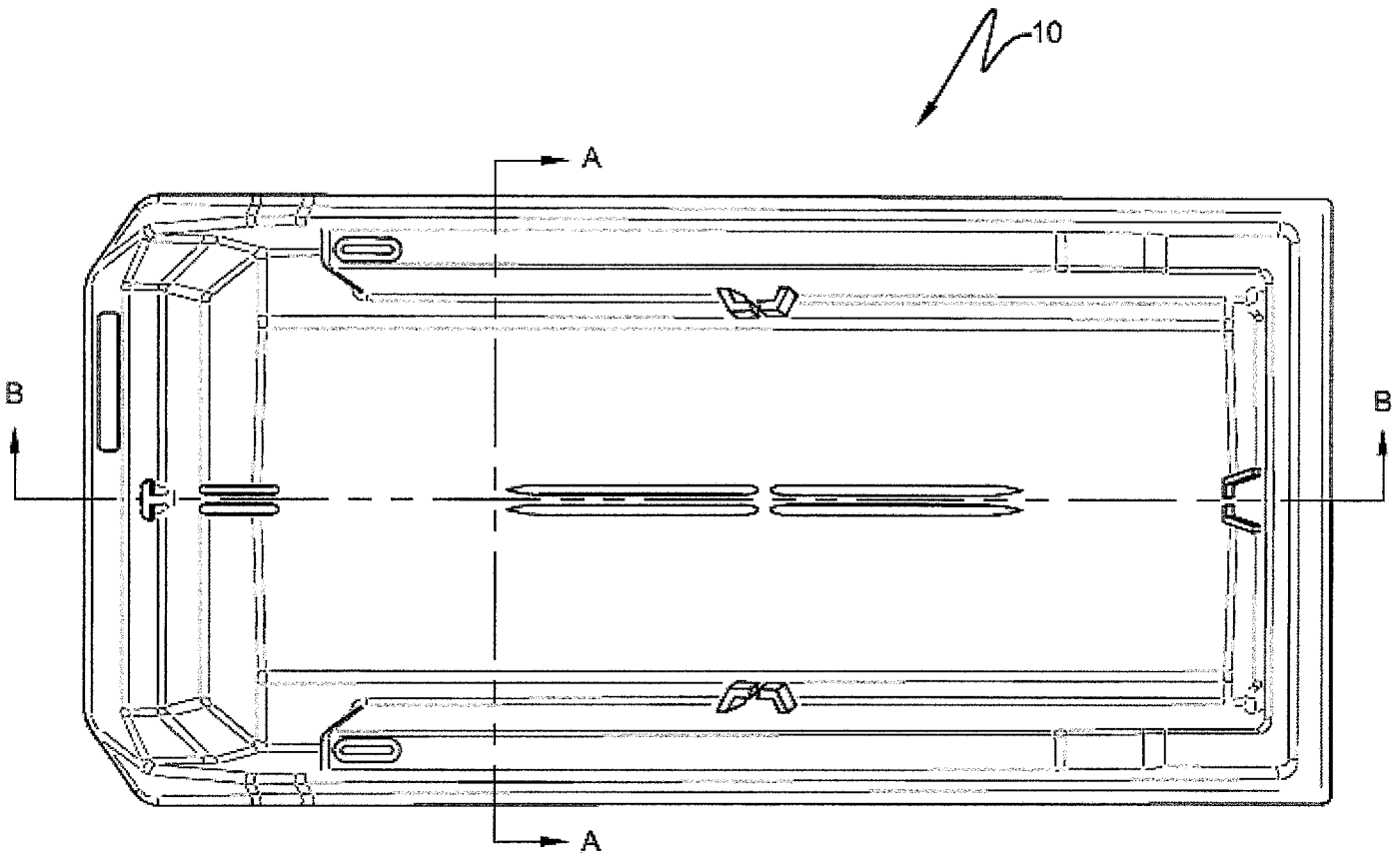
FIG. 3 is a top plan view of the preferred embodiment hanging, stackable and nestable bins shown in FIG. 2.
Figure 3A:
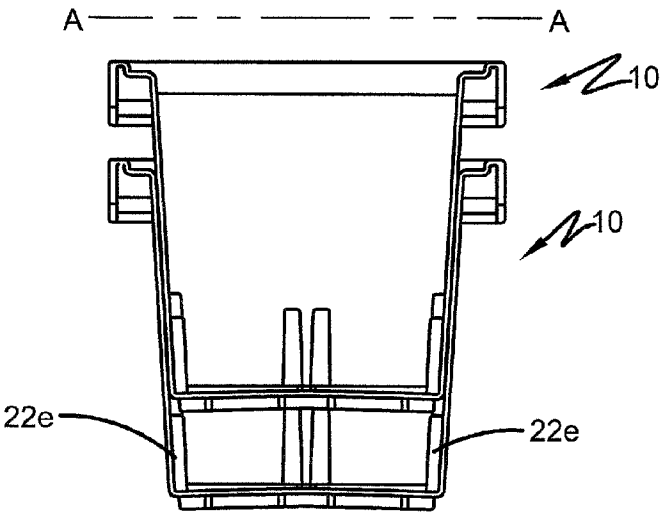
FIG. 3A is a front transverse cross-sectional view of the preferred embodiment hanging, stackable and nestable bins shown in FIG. 2.
Figure 3B:
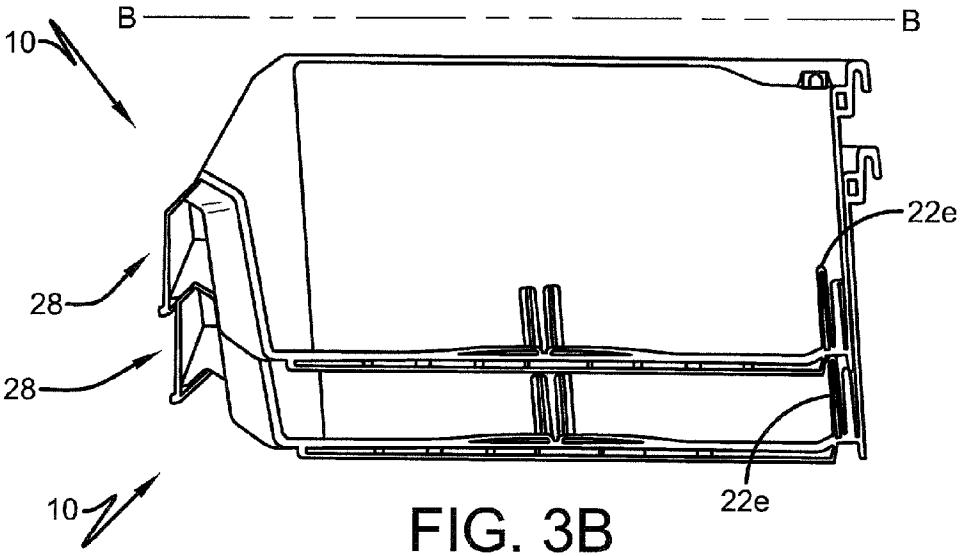
FIG. 3B is a longitudinal cross-sectional view of the preferred embodiment hanging, stackable and nestable bins shown in FIG. 2.

In accordance with yet another important feature of the present invention and with additional reference to FIGS. 2-3B, preferred embodiment bin 10 accommodates nesting of a preferred embodiment second bin 10.

As is best shown in FIG. 1B, first sidewall 14 and second sidewall 18 are angled slightly inwardly extending downwardly to their respective integral connections with bin floor 20. As a result, the transverse width between first sidewall 14 and second sidewall 18 decreases from the top of the walls to their integral connection with bin floor 20. In addition, retaining wall 27 of front wall 12 is angled slightly inwardly extending downwardly to the integral connection with bin floor 20. As a result, the longitudinal width of preferred embodiment 10 decreases from the top of retaining wall 27 to the integral connection with bin floor 20. With particular reference to FIGS. 2 and 3A, because the transverse and longitudinal width of preferred embodiment bin 10 is greater near the top of preferred embodiment bin 10, there is adequate space for the exterior shape of the preferred embodiment second bin 10 to fit within the interior space of the first bin, thereby enabling simplified nesting of the bins, as will now be described.

With particular reference to FIGS. 2-3B, when a preferred embodiment second bin 10 is nested within a preferred embodiment first bin 10, notch 50 of the second bin rests on support structure 22*e* of the first bin, providing rear nesting support. Additionally, hollow 24 (FIG. 1A) of preferred embodiment second bin 10 has a negative profile which corresponds to the upward geometry of hand hold 28 of preferred embodiment first bin 10, which allows the hollow to mate with hand hold 28, providing front nesting support. The combination of the rear support and the front support provided by preferred embodiment first bin 10 to a nested preferred embodiment second bin 10 enables simple nesting during bin storage, and also prevents the second bin from becoming jammed or stuck within the first bin, enabling simple removal of the second bin from the first bin.

It is contemplated that the hanging, stackable and nestable bin of the present invention may be formed by any suitable means, such as thermoforming, injection molding, blow molding, roto-casting, and any other commonly used forming technique. It is also contemplated that the hanging, stackable and nestable bin of the present invention may be formed of any suitable material, such as polypropylene, polyethylene, polycarbonate, styrene methyl methacrylate acrylic blend, high impact polystyrene, and any other materials commonly used to manufacture polymeric parts. It is further contemplated that that the hanging, stackable and nestable bin of the present invention supports the stacking and nesting of one or more bins.

Accordingly, the improved hanging, stackable and nestable bin is simplified, provides an effective, safe, inexpensive, and efficient structure which achieves all the enumerated objectives, provides for eliminating difficulties encountered with prior art bins, and solves problems and obtains new results in the art.

In the foregoing description, certain terms have been used for brevity, clarity and understanding; but no unnecessary limitations are to be implied therefrom beyond the requirements of the prior art, because such terms are used for descriptive purposes and are intended to be broadly construed. Moreover, the present invention has been described with reference to a preferred embodiment. It shall be understood that this illustration is by way of example and not by way of limitation, as the scope of the invention is not limited to the exact details shown or described. Potential modifications and alterations will occur to others upon a reading and understanding of this disclosure, and it is understood that the invention includes all such modifications and alterations and equivalents thereof.

Having now described the features, discoveries and principles of the invention, the manner in which the improved hanging, stackable and nestable bin is constructed, arranged and used, the characteristics of the construction and arrangement, and the advantageous, new and useful results obtained; the new and useful structures, devices, elements, arrangements, parts and combinations are set forth in the appended claims.

What is claimed is:

1. A bin comprising:

a) a floor, b) a rear wall integrally formed with said floor, a transversely extending notch formed between said floor and said rear wall, said rear wall including an upper rim having a longitudinal profile generally complementary to a longitudinal profile of said notch, said rear wall being angled inwardly toward an interior of said bin, said rear wall including a planer interior surface, c) a first sidewall integrally formed with said floor and said rear wall, said first sidewall including a planer interior surface, d) a second sidewall integrally formed with said floor and said rear wall, said second sidewall transversely spaced from said first sidewall, said second sidewall including a planer interior surface, e) a front wall integrally formed with said floor, said first sidewall, and said second sidewall, f) a pair of seating rims, wherein one of said pair of seating rims is formed on an interior surface of said first sidewall and the other of the pair of seating rims is formed on an interior surface of said second sidewall, g) a pair of footers, wherein one of said pair of footers extends downwardly from said first side wall and the other of said pair of footers extends downwardly from said second side wall, and h) a continuous upper rim formed on said first sidewall, said second sidewall and said rear wall, said continuous upper rim being formed with an outwardly and downwardly extending overhang, said overhang including a plurality of rib structures formed between the overhang and said upper rim to provide support to said overhang and to said bin.

2. The bin of claim 1, further comprising a pair of said bins including a first bin and a second bin, wherein the notch of said first bin mates with the upper rim of said second bin to provide stacking support when said first bin is stacked onto said second bin.

3. The bin of claim 1, further comprising a pair of said bins including a first bin and a second bin, wherein said pair of footers engage said seating rims to provide additional stacking support when said first bin is stacked on top of said second bin.

4. The bin of claim 1, wherein said bin is formed from a material selected from the group consisting of polypropylene, polyethylene, polycarbonate, styrene methyl methacrylate acrylic blend, and high impact polystyrene.

5. The bin of claim 1, wherein said front wall includes a handhold.

6. The bin of claim 5, wherein said handhold includes a discrete labeling area for attachment of a label.

7. The bin of claim 1, wherein a first pair of transverse divider support structures are integrally formed between said interior surface of said first sidewall and a top surface of said floor, and a second pair of transverse divider support structures are integrally formed between said interior surface of said second sidewall and said top surface of the floor, said first pair of transverse divider support structures and said second pair of transverse divider support structures enabling insertion of a transversely extending divider.

8. The bin of claim 7, wherein a plurality of transversely aligned divider alignment fins are formed on said top surface of said floor to provide support to said transversely extending divider.

9. The bin of claim 1, wherein a pair of longitudinal divider supports are formed between a top surface of said floor and an inward facing surface of said rear wall and a slot is formed in an inward facing surface of said front wall to enable insertion of a longitudinally extending divider between said pair of rear wall divider supports, said floor divider supports and said front wall slot.

10. The bin of claim 9, wherein a plurality of longitudinally aligned divider alignment fins are formed on said top surface of said floor to provide support to said longitudinally extending divider.

11. The bin of claim 1, further comprising a cleat formed in said rear wall, said cleat enabling said bin to be hung from a louver panel.

12. The bin of claim 1, wherein a bottom surface of said bin floor includes a plurality of longitudinal reinforcements.

13. The bin of claim 12, wherein said bottom surface of said bin floor further includes a plurality of transverse reinforcements.

14. The bin of claim 13, wherein said bottom surface of said bin floor further includes a plurality of diagonal reinforcements.

15. The bin of claim 1, wherein a seating rim is formed on an interior surface of said rear wall, said rear wall seating rim being continuously formed with said first sidewall and said second sidewall.

16. The bin of claim 1, wherein each of said pair of seating rims includes a depression formed in said seating rim.

17. The bin of claim 1, wherein said first sidewall and said second sidewall are angled slightly inwardly toward the bin floor.

18. The bin of claim 17, wherein said first and second sidewalls each include an outwardly extending fore wall.

* * * * *